United States Patent [19]

Inoue

[11] Patent Number: 4,653,517

[45] Date of Patent: Mar. 31, 1987

[54] IRON FOR STRAIGHTENING CURLY HAIRS

[75] Inventor: Taro Inoue, Okayama, Japan

[73] Assignee: Kabushiki Kaisha Inoue Shoten, Okayama, Japan

[21] Appl. No.: 630,453

[22] Filed: Jul. 11, 1984

[30] Foreign Application Priority Data

Jul. 25, 1983 [JP] Japan ..... 58-135591

[51] Int. Cl.[4] ..... A45D 1/12

[52] U.S. Cl. ..... 132/32 R; 219/225; 132/37 R

[58] Field of Search ..... 132/11 R, 11 A, 31 R, 132/32 R, 32 B, 33 R, 34 R, 37; 219/222, 225

[56] References Cited

U.S. PATENT DOCUMENTS

| | | | |
|---|---|---|---|
| 520,859 | 6/1894 | Nicol, Jr. | 132/32 B |
| 1,363,147 | 12/1920 | Morenilla | 132/32 B |
| 1,558,913 | 10/1925 | Parshall | 132/32 B |
| 1,591,065 | 7/1926 | Wertheim et al. | 132/32 B |
| 4,065,657 | 12/1977 | Zusser | 132/32 R |
| 4,477,716 | 10/1984 | Thaler et al. | 132/32 R |
| 4,479,047 | 10/1984 | Khaja et al. | 132/32 R |

*Primary Examiner*—Gene Mancene
*Assistant Examiner*—David I. Tarnoff
*Attorney, Agent, or Firm*—Flynn, Thiel, Boutell & Tanis

[57] ABSTRACT

An iron for straightening curly hairs includes a handle, a rod support mounted on the handle, a pair of first and second electrically heatable rods mounted at one end to the rod support and extending parallel to each other in spaced relationship, a rod moving plate pivotably mounted on the rod support, and a third electrically heatable rod rotatably mounted at one end on the rod moving plate and extending parallel to the first and second rods. The third rod is movable between a first position between the first and second rods and a second position away from the first and second rods in response to pivotal movement of the rod moving plate.

5 Claims, 4 Drawing Figures

IRON FOR STRAIGHTENING CURLY HAIRS

BACKGROUND OF THE INVENTION

The present invention relates to an iron for straightening curly hairs.

There has been practiced among beauty parlors a process for straightening curly hairs, which may be kinky hairs or curled by permanent waving, into straight hairs. According to the practice, a relaxer solution is applied to hair to break and remove cystine which is a binding substance in hair. It is relatively easy to straighten hairs curled by permanent waving back to original straight hairs. However, it is difficult to straighten originally curly hairs or kinky hairs since removal of the cystine loosens the pigment and cuticle, losing hair luster and gloss.

To solve the foregoing problem, as much cystine as possible should be retained in hairs and it is believed that curly hairs can be straightened by thermal treatment. Curling irons presently available for thermal treatment of hairs are however designed for curling straight hairs, but unable to straighten curly hairs. The inventor has made a study to devise a suitable iron structure for use in hair straightening and determine at what temperature hairs should be treated for being straightened. The inventor has experimentally confirmed that when curly hairs with binding by cystine being released or loosened are heated by an iron, the cystine in the curly hairs can be stretched to straighten the hair, and the iron should be of a construction capable of heating hairs while they are being curled and stretched.

SUMMARY OF THE INVENTION

It is an object of the present invention to provide an iron for straightening curly hairs reliably without damaging the hairs.

According to the present invention, there is provided an iron for straightening curly hairs comprising a handle, a rod support mounted on the handle, a pair of first and second electrically heatable rods mounted at one end to the rod support and extending parallel to each other in spaced relationship, a rod moving plate pivotably mounted on the rod support, and a third electrically heatable rod rotatably mounted at one end on the rod moving plate and extending parallel to the first and second rods. The third rod is maintained parallel with and is movable between a first position between the first and second rods and a second position away from the first and second rods in response to pivotal movement of the rod moving plate.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 4:
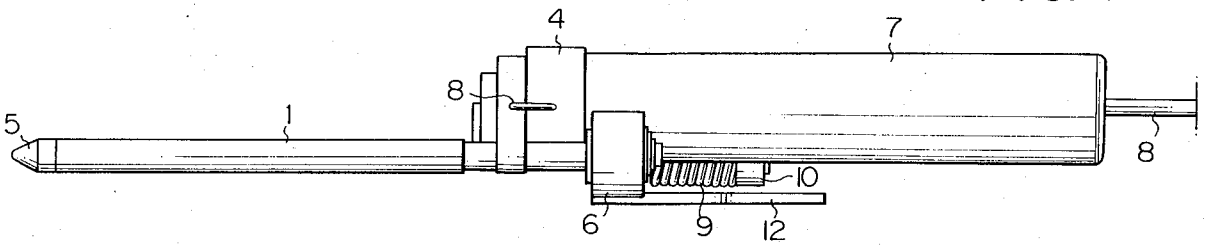
FIG. 4 is a plan view of the iron.
Figure 1:
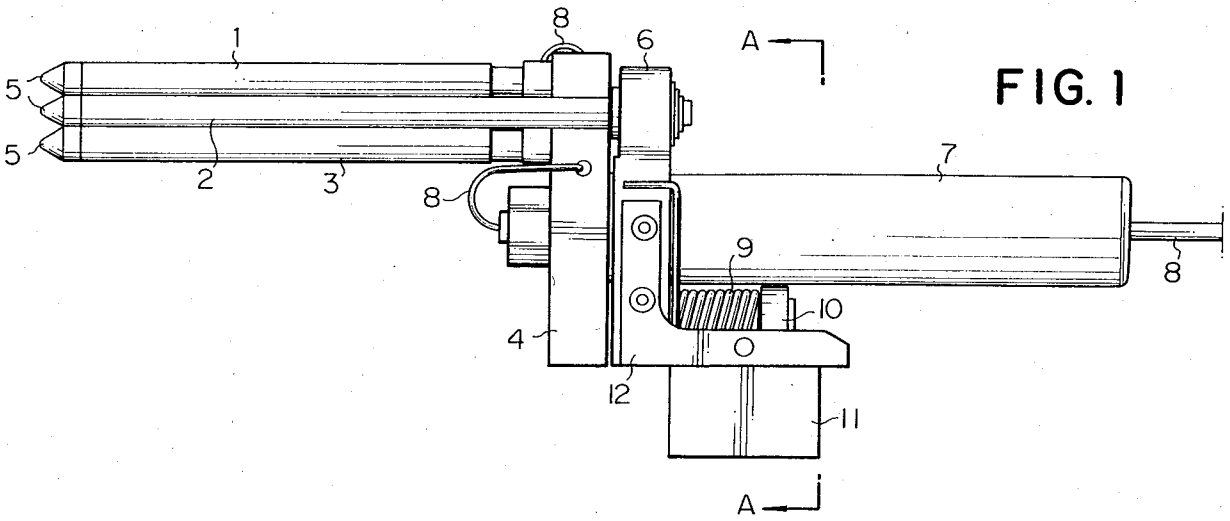
FIG. 1 is a front elevational view of a straightening iron according to the present invention.
Figure 2:
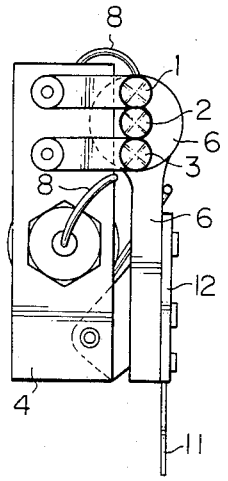
FIG. 2 is a side elevational view of the iron.

As shown in FIGS. 1 through 4, an iron according to the present invention comprises three rods 1, 2, 3 with heating wires inserted therein. The rods 1, 3 are secured at heating wire inlet ends thereof to a rod support 4 in parallel relation to each other and spaced from each other with a gap left therebetween. The opposite ends of the rods 1, 3 are closed by caps 5 fitted thereon. The rod 2 is placed between the rods 1, 3 and extends across the rod support 4. The rod 2 has a heating wire inlet end on which there is mounted a bearing supported by one end of a rod moving plate 6. The rod 2 is therefore rotatable about its own axis by the bearing. A cap 5 is fitted over the other end of the rod 2. The rods 1, 2, 3 are normally disposed in mutual contact in parallel relationship as shown.

Figure 3:
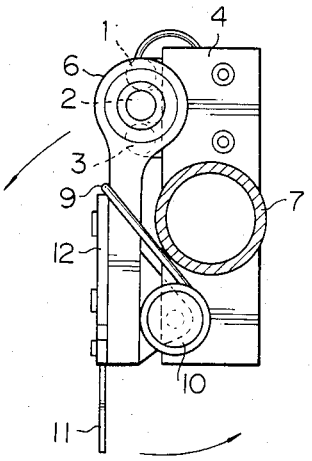
FIG. 3 is a cross-sectional view taken along line A—A of FIG. 1.

A cylindrical handle 7 has a distal end threaded centrally in the rod support 4. Electric cords 8 are inserted through the handle 7 into the rod support 4 in which the electric cords 8 are connected to the heating wires in the rods 1, 3 and also into the rod moving plate 6 in which the electric cords 8 are connected to the heating wire in the rod 2. A bolt 10 with a torsional spring 9 disposed therearound extends parallel to the handle 7 through a pivot portion 61 of the rod moving plate 6 and is threaded into the rod support 4. The spring 9 has one end engaging a surface of the rod moving plate 6 at a substantially central portion thereof for urging the rod moving plate 6 to turn about its pivot portion 61 toward the rod support 4. The bolt 10 hence functions as a pivot axis for the plate 6 and the rod 2 mounted thereon, which pivot axis is in parallel relation to the rod 2. An L-shaped presser 12 has one arm fastened to the rod moving plate 6 with the other arm having a presser tongue 11 extending away from the rod moving plate 6. When the presser tongue 11 is depressed, the rod moving plate 6 is turned around the bolt 10 counterclockwise as shown in FIG. 3 against the force of the spring 9 to swingably lift the rod 2 away from the rods 1, 3 in parallel relation thereto.

Operation of the iron thus constructed will be described.

After curly hairs to be straightened have been shampooed and dried, a first solution of relatively high viscosity, or relaxer, is coated sufficiently on the hairs. After 15 to 25 minutes, the hairs are washed with warm water to remove the first solution. Cystine which makes the hairs curly is now loosened and longitudinally arranged hair cells, known as the cortex, remain bound together. Then, with about 30% of water left in the washed hairs, ironing oil diluted by a small quantity of water is applied to the hairs which are then thoroughly combed. The electric cords 8 are connected to a control box (not shown) to pass an electric current through the heating wires in the rods. When the rods are heated up to 160° C.–170° C., the presser tongue 11 is manually depressed to displace the rod 2 sidewardly away from the plane defined by the axes of rods 1, 3. A suitable bundle of hairs is placed between the rods 1, 3 and the rod 2 so as to extend thereacross, and then the presser tongue 11 is released to allow the rod 2 to move back into the space between the rods 1 and 3. With the bundle of hairs held slightly under tension, the iron is moved at a speed of about 1.5 cm to 2 cm per second from the proximal end to the distal end of the hair bundle. During this process, water contained in the hairs is vaporized to heat the hairs to the core, with the result that the hairs are permitted to swell uniformly as a whole. Since the rod 2 rotates about its own axis as the iron is moved, the iron can smoothly move along the hairs without breaking them. When the hairs pass between the rods 1, 3 and the rod 2, the rods heat the face and back of the hair bundle to cause the cystine to be evenly loosened. Accordingly, the curly hairs are straightened by the rods as the hairs move past the rods. After the hairs have been ironed, a second viscous solution, known as a neutralizer, is applied to the hairs. Upon elapse of ten minutes, the hairs are washed with water. Since the cystine in the treated hairs is fixed as being stretched, the hairs remain straightened.

At the time the hairs pass through the three rods, the hairs are subjected to tension and also heated by the rods at the face and back of the hair bundle. As the rods move along the hair bundle, water contained in the hairs is turned into vapor which reaches deeply into the hair bundle. Therefore, the cystine that makes the hairs curly is uniformly loosened to reduce its binding force. The cystine is then stretched to allow the curly hairs to be straightened under the tension to which the hairs are subjected while they go past the rods. When the hairs are cooled, the cystine is fixed as being stretched. The operation to straightening hairs with the iron of the invention is quite simple and can be effected in about 2 hours to straighten curly hairs. Since cystine is not broken but retained in the hairs, they can be curled again by permanent waving.

Although a certain preferred embodiment has been shown and described, it should be understood that many changes and modifications may be made therein without departing from the scope of the appended claims.

What is claimed is:

1. An iron for straightening curly hairs, comprising:

(a) a handle;

(b) a rod support mounted on said handle;

(c) a pair of first and second electrically heatable rods mounted at one end to said rod support and extending parallel to each other in spaced relationship;

(d) a rod moving plate pivotably mounted on said rod support for pivoting about an axis which is substantially parallel with said first and second rods; and (e) a third electrically heatable rod mounted at one end on said rod moving plate and extending parallel to said first and second rods, said third rod being movable in parallel relation to said first and seconds rods between a first position between said first and second rods and a second position spaced away from said first and second rods in response to pivotal movement of said rod moving plate about said axis.

2. An iron for straightening curly hairs according to claim 1, including a bolt by which said rod moving plate is pivotably mounted on said rod support, and a torsional spring disposed around said bolt and having one end acting on said rod moving plate for normally urging said third rod to move into said first position.

3. An iron for straightening curly hairs according to claim 1, including a presser mounted on said rod moving plate and having a presser tongue which is manually depressable to turn said rod moving plate in a direction to move said third rod into said second position.

4. An iron according to claim 1, wherein said third rod is rotatably mounted on said rod moving plate for rotation about its longitudinally extending axis.

5. A method of straightening curly hairs, comprising the steps of:

(a) providing a heating iron having first, second and third elongated heating rods disposed in parallel relationship with said third rod being positionable generally between said first and second rods and being movable transversely away from said first and second rods so as to create a space between said rods while maintaining said third rod generally parallel to said first and second rods;

(b) moving said third rod transversely away from said first and second rods by pivoting about an axis which is substantially parallel with said first and second rods so as to create said space therebetween while maintaining all of said rods in generally parallel relationship;

(c) inserting a bundle of wetted hairs into the space so that the hairs extend transversely across said rods;

(d) moving said third rod transversely relative to said first and second rods back into the space between said first and second rods to effect gripping of the bundle of hairs;

(e) heating said rods to a desired temperature; and (f) slowly moving the heating iron along the bundle of hairs from a proximal end thereof to a distal end thereof to effect heating and straightening of the hairs.

* * * * *